United States Patent [19]

Schober et al.

[11] 3,991,948

[45] Nov. 16, 1976

[54] VIBRATORY MILL FOR DISINTEGRATING MATERIAL

[75] Inventors: Johann Schober, Gleisdorf; Hermann Zimmer, Graz, both of Austria

[73] Assignees: Vereinigte Osterreichische Eisen- und Stahlwerke - Alpine Montan Aktiengesellschaft, Vienna; Binder & Co. Aktiengesellschaft, Gleisdorf, both of Austria

[22] Filed: May 27, 1975

[21] Appl. No.: 580,889

[30] Foreign Application Priority Data

June 4, 1974 Austria ..... 4605/74

[52] U.S. Cl. ..... 241/175

[51] Int. Cl.[2] ..... B02C 17/14

[58] Field of Search ..... 241/137, 153, 175, 284, 241/285 R

[56] References Cited

UNITED STATES PATENTS 2,760,729 8/1956 Mittag et al. ..... 241/175

FOREIGN PATENTS OR APPLICATIONS 195,733 6/1957 Austria

*Primary Examiner*—Roy Lake
*Assistant Examiner*—Neil Abrams
*Attorney, Agent, or Firm*—Kurt Kelman

[57] ABSTRACT

In a vibratory mill, a plurality of parallel, horizontal grinding tubes are mounted in groups on an upper and a lower part of a carrier. The two carrier parts are linked together by two pairs of links which form a parallel crank linkage and stationary bearings mount each of the links intermediate their ends for pivoting about an axis parallel to the grinding tube axes. An eccentric drive mechanism is arranged to vibrate the carrier in a direction transverse to the grinding tube axes. The drive mechanism includes an eccentric mounted on one of the carrier parts for imparting to the carrier an amplitude of vibration of at least 15 mm about a central position of the links which is inclined from the horizontal at an angle of 30°–60°, preferably 45°, a connecting rod connected to the eccentric and extending at a right angle to the central position of the links, and a rubber or helical spring connecting the connecting rod to the other carrier part. The carrier parts are connected by connecting rods extending at a right angle to the central position of the links, rubber or helical springs being interposed between the rods and the carrier parts.

10 Claims, 11 Drawing Figures

VIBRATORY MILL FOR DISINTEGRATING MATERIAL

Figure 1:
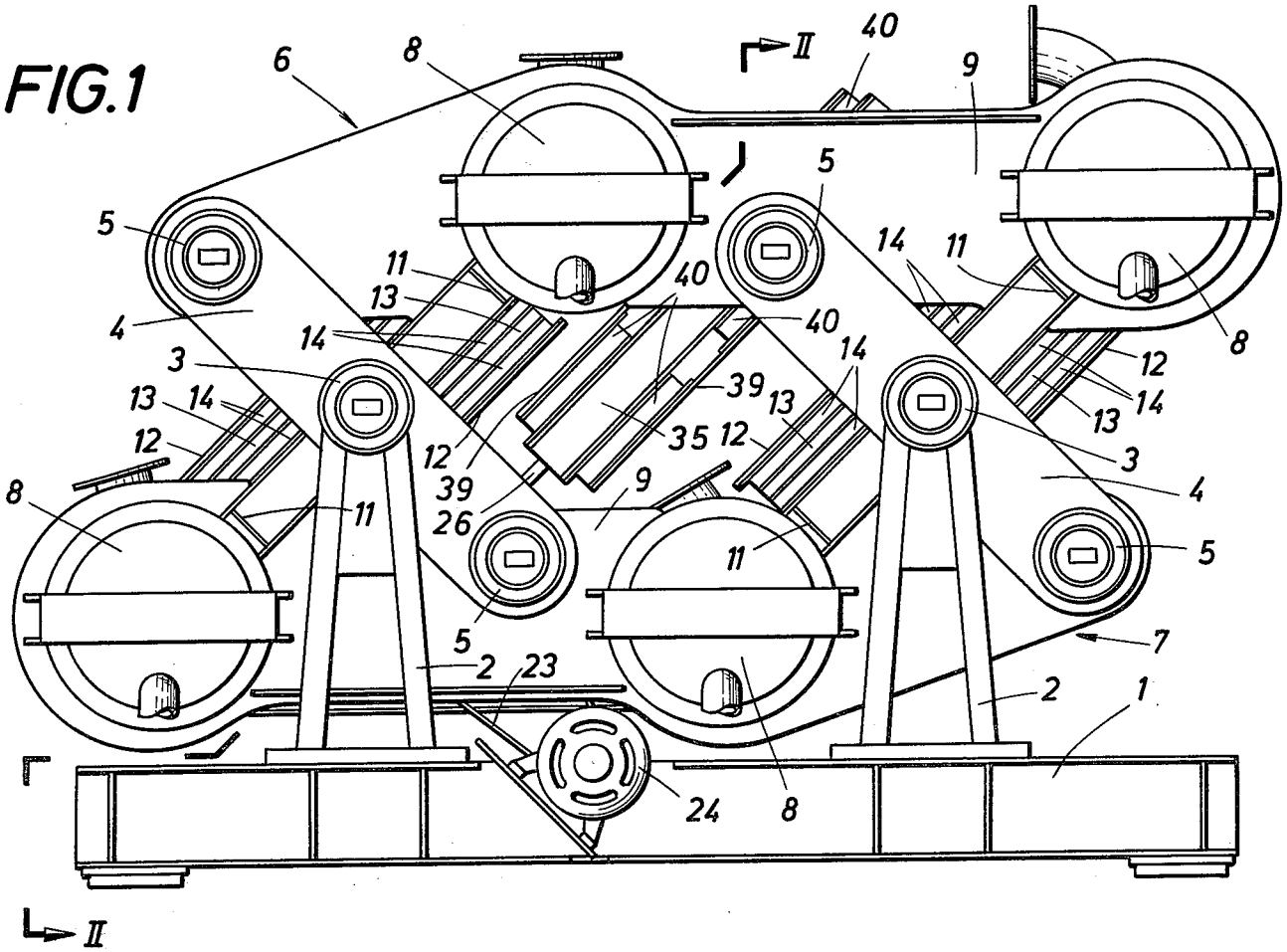

This invention relates to a vibratory mill for disintegrating material, comprising parallel horizontal grinding tubes which are partly filled with grinding elements and are held in a grinding tube carrier mounted to be vibratory in a direction which is transverse to the axes of the tubes and is adapted to be vibrated by means of an eccentric drive mechanism.

The material to be ground is disintegrated as a result of the cooperation of the vibratory motion imparted to the grinding tubes of vibratory mills and of the grinding elements which are contained in the grinding tubes and which impinge on each other to crush the material contained between said elements. The grinding action depends decisively on the direction of the vibratory motion of the grinding tubes. It has been found that a reciprocating motion along a straight vertical or horizontal line results in a much smaller grinding action than a strictly circular vibration of the grinding tubes. For this reason grinding tubes which vibrate along paths which approximate a circle as closely as possible have been proposed. Where a plurality of grinding tubes are used, it is desirable to eliminate the need to impart vibration to each tube independently. To this end, the grinding tubes are usually inserted in a grinding tube carrier which is mounted on usually cylindrical rubber members and which can be vibrated by means of a rotary unbalance member rotatably mounted in the grinding tube carrier. As a result, the grinding tubes are moved in unison along circular paths which extend transversely to the longitudinal axis of the grinding tubes. The rotation of the rotary unbalance members and the movement of the grinding tube carrier in phase with said rotary unbalance members produce in said machines strong vibratory forces, which must be transmitted by the rubber members to the foundation of the machine. Besides, a large driving energy is required so that larger amplitudes of vibration are uneconomical although large amplitudes of vibration may have a desirable influence on the grinding action.

To avoid a transmission of particularly strong forces to the machine foundation, a vibratory mill has been proposed which comprises two horizontal grinding tubes arranged one beside the other in a common carrier (French Pat. No. 1,097,564) and in which the grinding tube carrier is rotatably mounted between the two grinding tubes adjacent to the center of gravity of the unit consisting of the grinding tube carrier and the grinding tubes, and an eccentric drive mechanism is provided to vibrate the grinding tube carrier about this axis of rotation which is parallel to the tube axes. As a result, the vibrating masses are balanced to a high degree and it will be sufficient for the foundation to carry substantially only the weight of the structure. On the other hand, that known design has the disadvantage that the grinding tubes vibrate substantially in a vertical direction so that a strong grinding action cannot be produced, and that the grinding tubes revolve about the axis of rotation of the grinding tube carrier so that the amplitude of vibration varies across the cross-section of the tube. This results in differential accelerations of the grinding elements and consequently in different grinding actions across the cross-section of each tube. Besides, the eccentric drive mechanism has a high driving energy requirement, which can be only insignificantly reduced by the provision of resilient supports for the grinding tubes.

For these reasons, these known vibratory mills have not been successful compared to vibratory mills in which grinding tubes are moved along circular paths, particularly because the energy required to produce circular vibration by means of rotary unbalance members can also be reduced by elastic spring means connecting the grinding tubes to each other, provided that the grinding tubes are excited to vibrate near the resonant frequency of the vibratory system.

Material to be ground can be disintegrated not only by ball- or rod-shaped grinding elements but also by tubes which are nested with a clearance between adjacent tubes and which by means of an eccentric mass are vibrated in a plane which is transverse to the axis of the container so that said tubes perform a planetary revolving motion and roll on the inside wall of the container. The material to be ground is then crushed in the clearance spaces between adjacent tubes. These known disintegrating apparatus do not permit of a separation of the ground material into different particle size fractions. For this reason it has been proposed (Austrian Pat. No. 195,733) to provide an uneven mass distribution for the nested tubular grinding elements so that they have eccentric centers of gravity, and to cause the containers to vibrate in the vertical axial plane so that this vibration in the vertical axial plane does not only cause each grinding element to perform a planetary revolving motion in another grinding element but also causes the material being ground to advance along the axis of the container. This is due to the fact that the vibration causes the material which has been disintegrated and ground to a small particle size to rise along the suitably inclined container and to be separated at the same time so that particles in different size ranges can be taken at different points along the system of grinding elements. To minimize the force required to excite the vibration, the containers of each pair thereof are connected by two pairs of links to form a parallel crank linkage having pivotal axes which extend transversely to the axes of the containers. These links are mounted between their end pivots on stationary axes, which extend parallel to the end pivotal axes, and the links can vibrate about a central position, in which they are inclined from the horizontal. As a result, the two containers connected by the links can vibrate only in a direction which is determined by the central position of the links. The containers are driven by an eccentric drive mechanism, which is connected to each container by a connecting rod, by which the container is caused to vibrate. Because the containers are also connected by leaf springs, the drive energy may be very small if they are excited to vibrate at a frequency near the resonant frequency of the vibratory system. This known disintegrating apparatus has the advantage that the driving energy requirement is minimized because the containers which together with the links form a parallel crank linkage are mounted by means of the links so that a considerable balancing of masses can be accomplished and the foundation of the machine need not take up strong vibratory forces. The apparatus has the disadvantage that the containers vibrate in a vertical axial plane so that a strong grinding action cannot be produced, and that special grinding elements must be used which are expensive because their center of gravity is eccentric. This high expense is significant because the grinding elements wear out.

To provide a simple structure and simple drive means, it has already been proposed (German Pat. No. 708,694) to vibrate the grinding mill container along an at least approximately straight line which is inclined from the horizontal. This type of vibratory mills has been abandoned, however, because vibratory mills in which the grinding elements perform a circular vibration have proved to produce a better grinding action. For this reason, it is desired in modern vibratory mills to vibrate the grinding elements along paths which approximate a circle as closely as possible although such circular vibration involves large vibratory forces and a comparatively high energy requirement.

It is an object of the invention to provide a vibratory mill which serves to disintegrate material and which produces a strong grinding action with simple grinding elements and is comparatively smooth in operation and has a low energy requirement.

In an apparatus of the kind described first hereinbefore this object is accomplished according to the invention in that the grinding tube carrier consists of two parts, each of which is associated with one group of grinding tubes, that the two parts of the grinding tube carrier are connected by at least two pairs of links to form a parallel crank linkage having pivotal axes which are parallel to the axes of the grinding tubes, that the links of the parallel crank linkage are pivotally mounted between their end pivots in stationary bearings and are vibratable about a central position which is inclined from the horizontal at an angle of 30°–60°, preferably 45°, that the amplitude of vibration of the parts of the grinding tube carrier is at least 15 mm, that the eccentric of the eccentric drive mechanism is mounted on one part of the grinding tube carrier and is connected to a connecting rod, which extends approximately at right angles to the central position of the links, that said connecting rod is connected by a rubber spring or helical spring to the other part of the grinding tube carrier, and that the two parts of the grinding tube carrier are connected by elastic spring means, which comprise rods, which extend approximately at right angles to the central position of the links and are connected by rubber springs or helical springs to the parts of the grinding tube carrier. Whereas it has been proved that the strictly circular vibration of the grinding mill containers will result in a better grinding action than a straight-line vibration thereof if the amplitude of vibration is of the usual order of a few millimeters, it has surprisingly been found that this will be no longer the case if the amplitude of the linear vibration having an inclination of about 45° is at least 15 mm. It is apparent that a grinding action which is stronger than that produced by a circular vibration can be obtained if the amplitude of vibration is particularly large, at least 15 mm, and the direction of vibration is inclined, preferably at an angle of 45°.

Special design features must be adopted if such large amplitudes of vibration are to be produced with economical means. For instance, the connection of the two parts of the grinding tube carrier to form a parallel crank linkage and the mounting of the grinding tube carrier on stationary axes extending through the links has the result that the two parts of the grinding tube carrier vibrate in mutually opposite directions so that there is a balancing of masses. It will be understood that the mass contained in one carrier part must be as large as the mass contained in the other carrier part. As a result of this balancing of masses, the forces to be taken up by the foundation of the machine are very small compared to the forces to be taken up by the foundations of known vibratory mills having grinding tubes vibrated transversely to their axes. For this reason, special measures ensuring that the forces occurring will be taken up need not be adopted in conjunction with the vibratory mill according to the invention. The incorporation of the parts of the grinding tube carrier in a parallel crank linkage ensures that the grinding tubes are also moved parallel to themselves with equal amplitudes along arcs of a circle so that uniform grinding actions are ensured.

To minimize the energy required to drive a vibratory mill according to the invention, the two parts of the grinding tube carrier are connected by elastic spring means which comprise rods that extend approximately at right angles to the central position of the links and are connected by rubber springs or helical springs to the parts of the grinding tube carrier. As the parts of the grinding tube carrier vibrate in mutually opposite directions, the rod remains substantially at rest whereas the springs are deformed in accordance with the vibration of the parts of the grinding tube carrier. Because the energy stored by said springs when they were stressed in one direction of movement is delivered by said springs to the parts of the grinding tube carrier when the motion has been reversed, these springs ensure that the driving power will be minimized if vibration is excited at a frequency near the resonant frequency of the masses which are connected by the springs to form a vibratable system.

Vibration is excited by an eccentric drive mechanism secured to one of the two parts of the grinding tube carrier and connected to a connecting rod connected to the other part of the grinding tube carrier by a rubber spring or helical spring. In such an arrangement, the elastic coupling between the drive mechanism and the vibratory masses ensures that no problems will be involved in the transmission of the required energy as the machine is started up because the vibration will build up until the operating conditions have been attained. By means of this eccentric drive mechanism, large amplitudes of vibration can be obtained even at relatively low rotational speeds whereas this is not possible in machines excited by rotary unbalance members because the centrifugal force decreases in proportion to the square of the circumferential velocity. For this reason, a given amplitude of vibration at a lower speed can be produced only if the revolving masses are increased so that the weight of the vibrating parts of the machine will be increased too.

The present mounting of the links and the parts of the grinding tube carriers involves unilateral stresses in the bearings so that difficulties are involved in the use of rolling-element bearings. For this reason it is a feature of the invention to provide bearing bushings which consist of a rubber ring, a split metallic inner shell vulcanization-bonded to the rubber ring, and a metallic outer shell, which is also vulcanization-bonded to the rubber ring and consists of at least two spaced apart shell parts. When the bearing bushings are installed, the outer shell is non-rotatably held in the bearing bore, the inner shell is non-rotatably mounted on the journal and the rubber rings are under compressive stress between the outer and inner shells. Because the outer shell of the bearing bushing is non-rotatably held in the bearing bore and the inner shell is non-rotatably held on the journal, these elements of construction will not be subjected to frictional forces which might cause the bearing to wear. Owing to this special mounting of the outer and inner shells of the bearing bushing, the rubber ring is compelled to take up any torsion. This will be possible only if the rubber ring is under an initial radial stress which prevents a tensile stress in individual parts of ring. The resilient mounting can also compensate for inevitable manufacturing tolerances. The split inner shell and the outer shell composed of at least two shell parts permit of an adaptation of the bearing bushings to existing outside and inside diameters.

The springs are very highly stressed by the vibration of the parts of the grinding tube carriers. To ensure that the spring will withstand such stresses even through long periods of operation, it is a further feature of the invention that the rubber springs consist of at least two metal-clad rubber elements, which carry the connecting rod between them and together with the connecting rod are inserted in a housing, which is secured to the respective part of the grinding tube carrier. It is already known to use such metal-clad rubber elements as shock absorbers in crushing mills, the grinding jaws of which are supported by means of the metal-clad rubber elements on the frame in such a manner that the vibration transmitted to the frame is minimized. According to the invention, on the other hand, the metal-clad rubber elements are used to connect the two parts of the grinding tube carrier so that said parts together with the metal-clad rubber elements form a vibratory system. Provided that there is a sufficient dissipation of the heat generated as a result of the internal damping in the rubber elements, the rubber springs according to the invention are particularly reliable in operation and may be used even in highly humid environments.

Where high ambient temperatures preclude the use of such rubber springs, the invention contemplates the use of helical springs which are provided at each end with a convolution smaller in diameter than the remaining convolutions and in which springs each of these end convolutions is gripped between a mounting plate and a spring abutment plate surrounded by the convolutions of the spring and axially forced against the mounting plate by a screw. Because each end convolution is axially held between a spring abutment plate and a mounting plate, the mounting plate can transmit tensile and compressive forces to said spring. This is required for the use of the springs in vibratory mills according to the invention.

To avoid an articulated joint between the connecting rod of the eccentric drive mechanism and the corresponding part of the grinding tube carrier, it is a preferred feature of the invention to provide a eccentric drive mechanism with a resiliently flexible connecting rod so that the lateral deflection imparted to the rod as a result of the rotation of the eccentric is compensated by the connecting rod itself.

To enable the adaptation of the vibratory mill to different conditions, it would be desirable to enable an adjustment of the eccentric without influencing the load capacity of the eccentric drive mechanism. To this end, it is a preferred feature of the invention that the connecting rod of the eccentric drive mechanism is rotatably mounted on a bushing non-rotatably carried by the eccentric and which is replaceable by bushings which have the same outside diameter and bearing bores which contain the eccentric and have different eccentricities with respect to the outside diameter. The use of different bushing then permits a change of the eccentricity which is composed of the eccentricities of the eccentric shaft and of the bushing.

According to another preferred feature of the invention, troughs for feeding material to be ground to the individual grinding tubes and troughs for discharging ground material are secured to the parts of the grinding tube carrier and extend transversely to the axes of the tubes. Because the troughs secured to the parts of the grinding tube carrier extend transversely to the axes of the tubes, the axes of the troughs have the same direction as the vibration, that is transverse to the axes of the tubes, so that the troughs are virtually vibratory conveyors for feeding material to be ground from a feeding station to the several grinding tubes.

Figure 2:
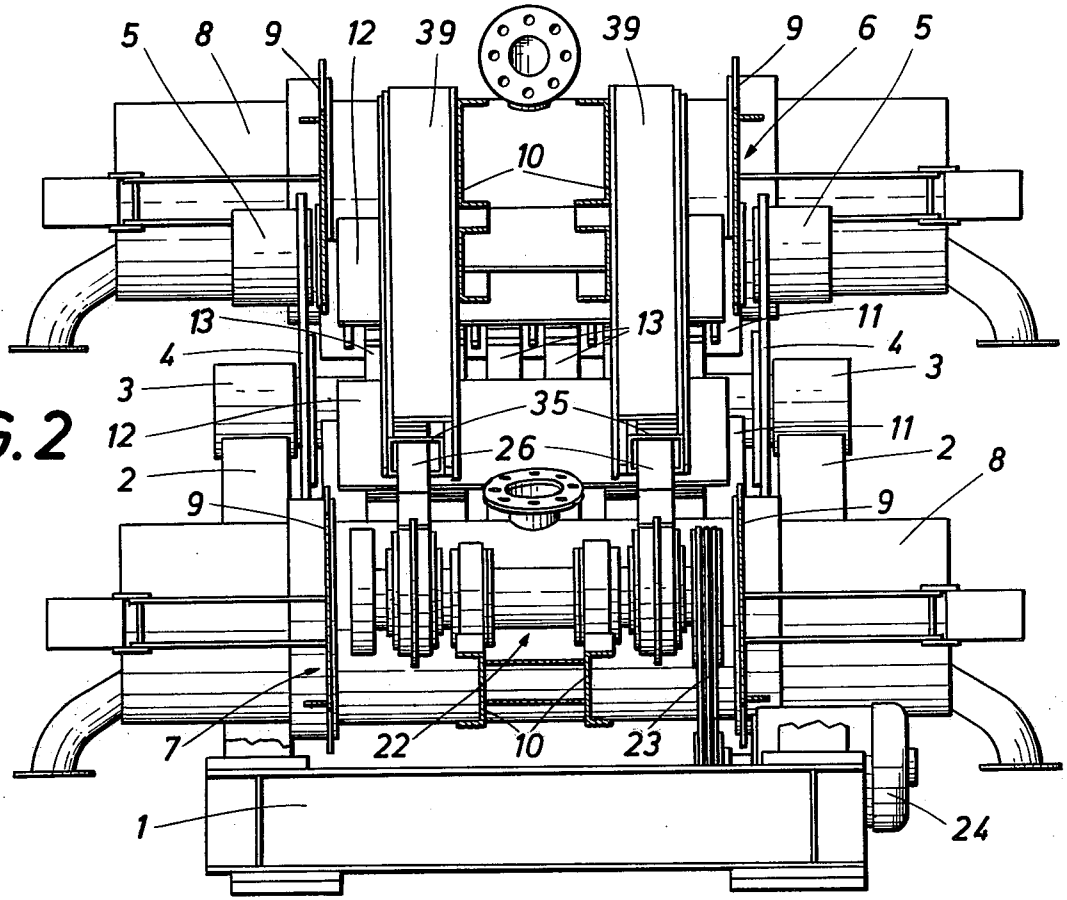

An embodiment of the invention is shown by way of example in the accompanying drawing, in which FIG. 1 is a side elevation showing a vibratory mill according to the invention and FIG. 2 is a sectional view taken on line II—II of FIG. 1 and showing the vibratory mill.

Figures 3, 4:
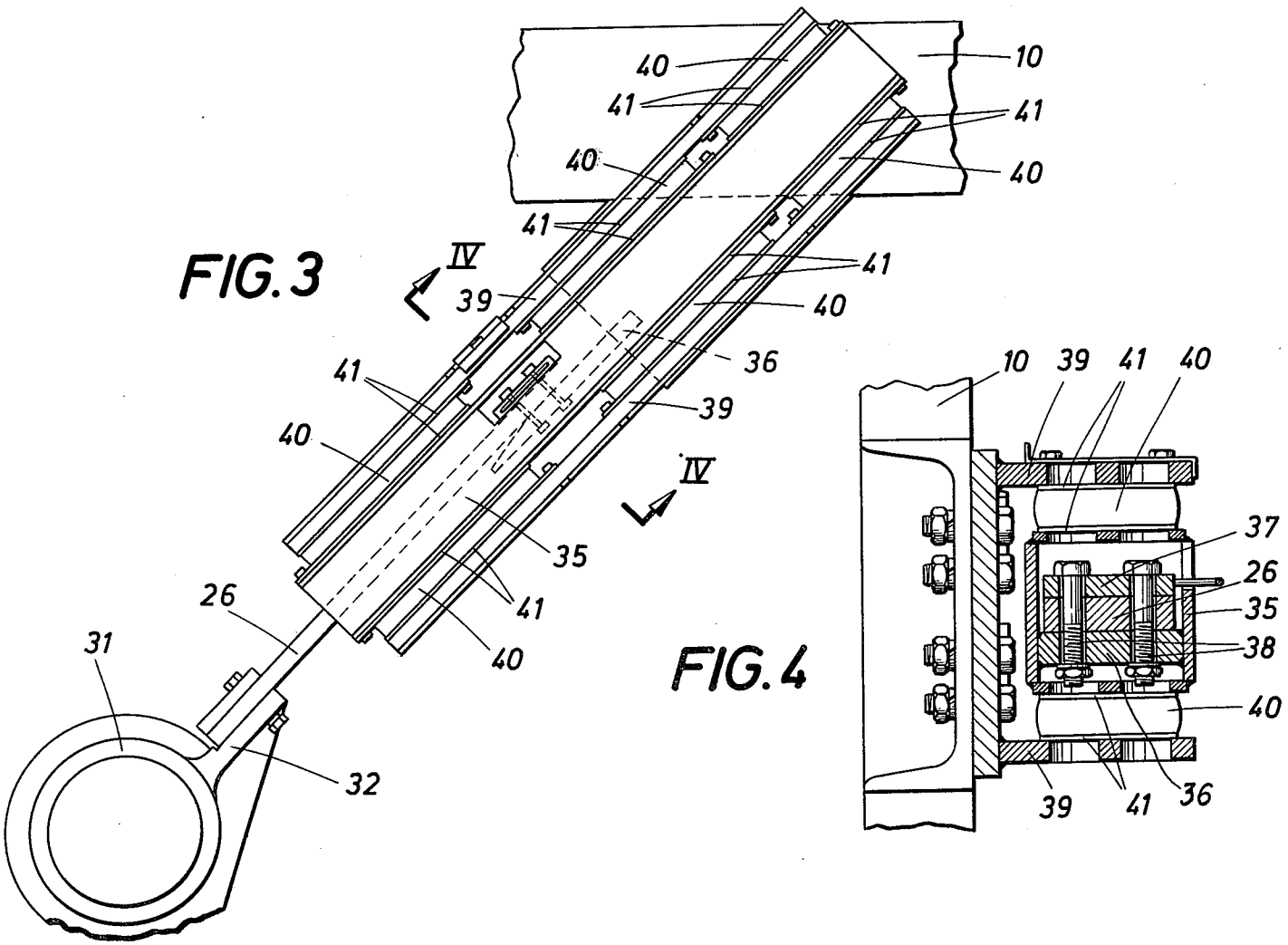
Figure 5:
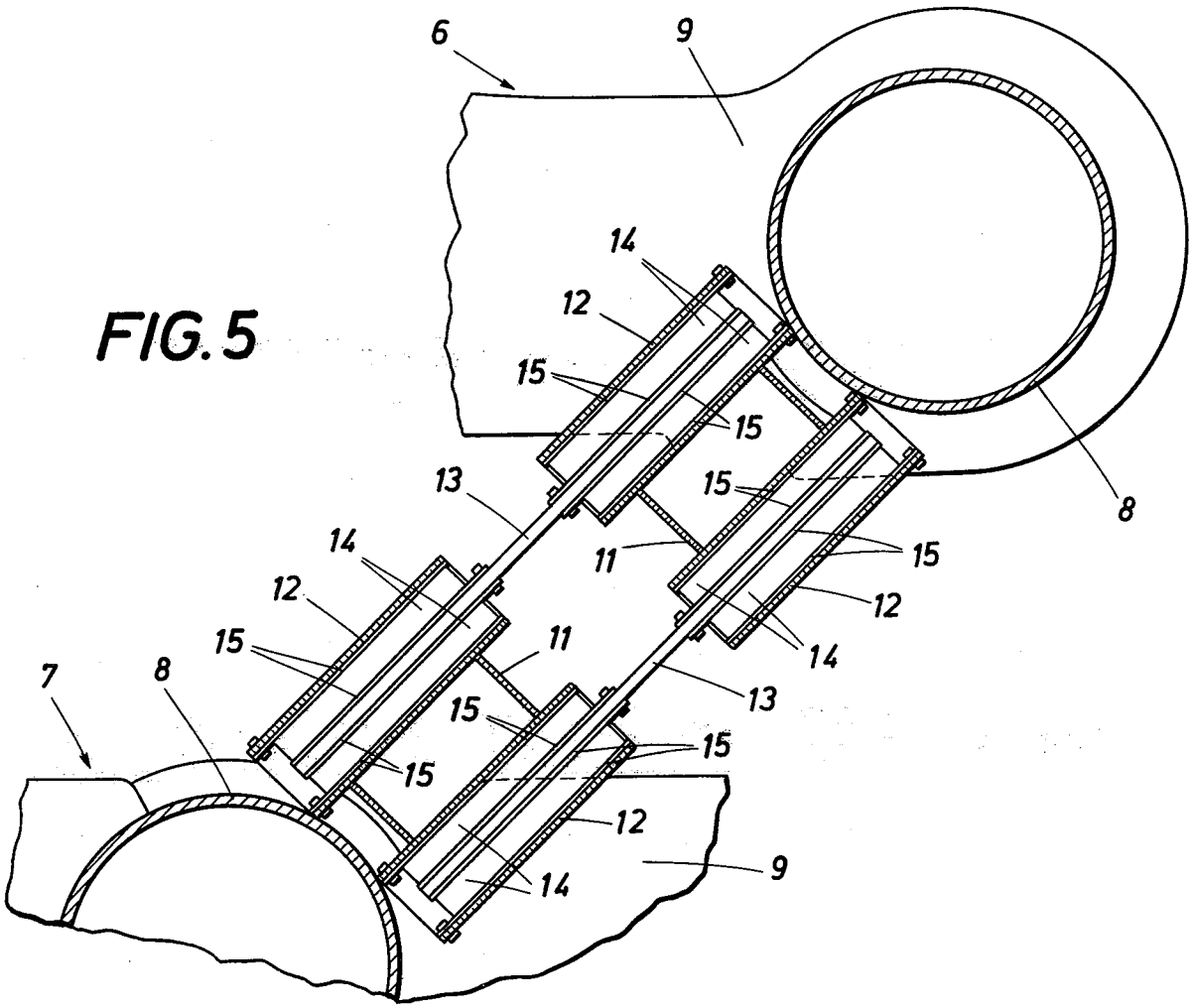
Figures 6, 7:
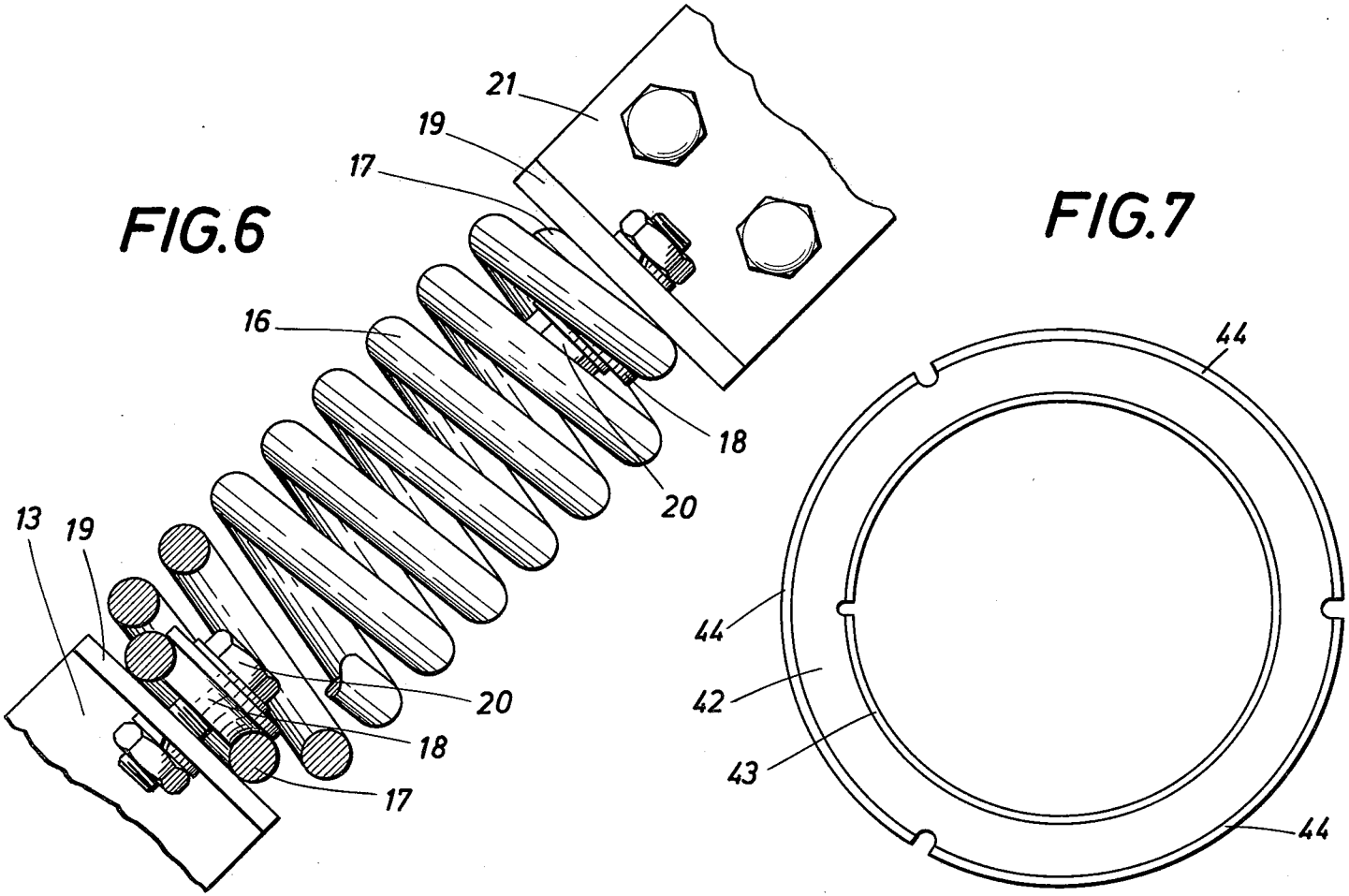
Figure 11:
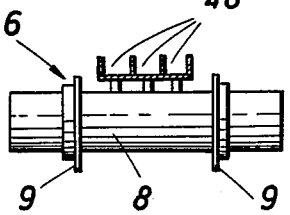
Figure 10:
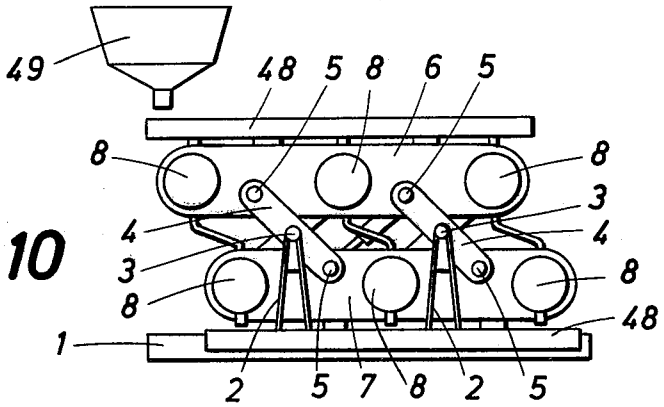
Figure 8:
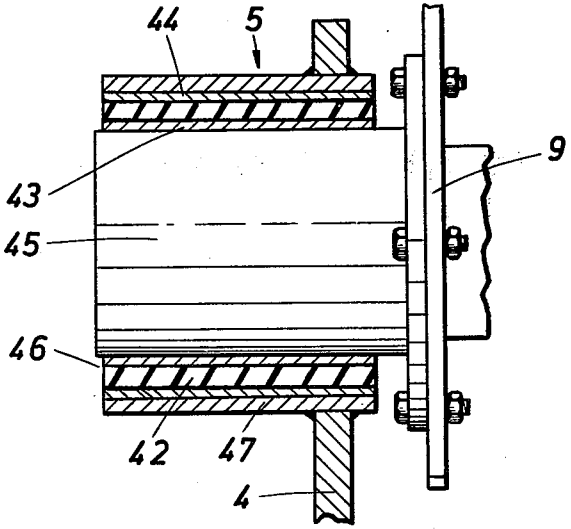
Figure 9:
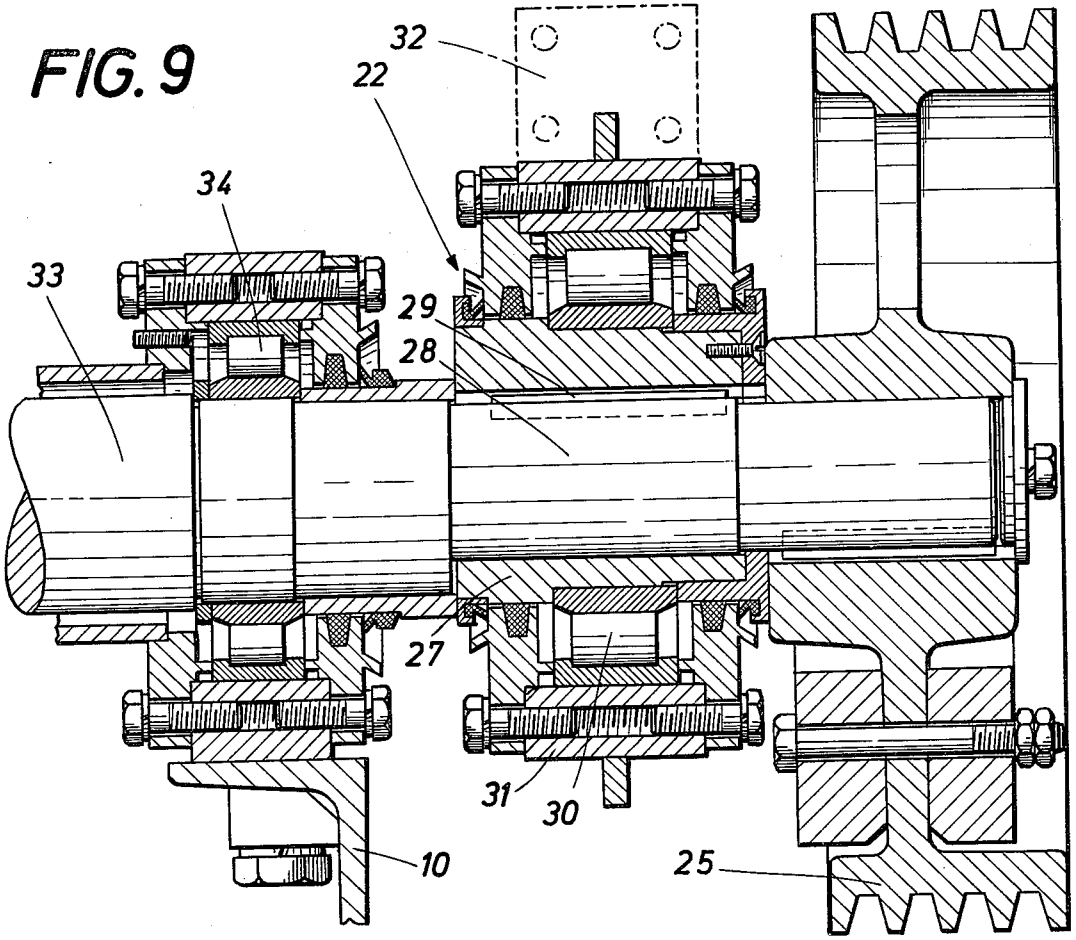

FIG. 3 shows how a connecting rod of the eccentric drive mechanism is connected to a part of the grinding tube carrier by rubber springs used according to a preferred feature of the invention, FIG. 4 is a sectional view taken on line IV—IV of FIG. 3, FIG. 5 is a side elevation showing elastic spring means connecting the two parts of the grinding tube carrier, FIG. 6 is a partly sectional view showing a helical spring, which may be used instead of rubber springs, FIG. 7 is a front elevation showing a bearing bushing according to a preferred feature of the invention, FIG. 8 is an axial sectional view showing a bearing which comprises a bearing bushing used according to a preferred feature of the invention, FIG. 9 is an axial sectional view showing an eccentric drive mechanism used according to the preferred feature of the invention, FIG. 10 is a side elevation showing a vibratory mill with troughs which are secured according to a preferred feature of the invention and serve to feed material to be ground and to discharge ground material, and FIG. 11 is a transverse sectional view showing troughs for feeding three grinding tubes.

In the vibratory mill shown in the drawings as an illustrative embodiment of the invention, a base frame 1 carries two pairs of bearing brackets 2, each of which carries a bearing 3 for a two-armed link 4. These links 4 have end bearings 5, in which a grinding tube carrier consisting of two parts 6 and 7 is mounted. Each part 6, 7 of the grinding tube carrier comprises beams 10 and web plates 9 which are connected by inserted grinding tubes 8. The parts 6 and 7 of the grinding tube carrier and the links 4 connecting said parts form a parallel crank linkage having pivotal axes which are parallel to the axes of the grinding tubes 8 so that the latter can be moved only parallel to their axes.

The two parts 6 and 7 of the grinding tube carrier are connected by elastic spring means so that a vibratory system is provided. For this purpose (see FIG. 5), the web plates 9 are connected by box-section beams 11, to which plates 12 are secured which together with the box-section beams 11 form a housing. A connecting rod 13 protrudes into said housing. Rubber members 14 are interposed between the connecting rods 13 and the housing walls formed by the box-section beams 11 and the plate 12. The rubber members 14 are secured to the plates 12, to the box-section beams 11 and to the connecting rod 13 by vulcanization-bonded connecting plates 15, which together with the rubber members 14 form metal-clad rubber connectors which are bolted to the plates 12, the box-section beams 11 or the connecting rod 13. To ensure a long lift of each of the rubber springs composed of two rubber members 14, the rubber members are held under compressive stress between the plates 12 and the box-section beam 11 and the connecting rod 13. The compressive stress is so selected that the deformation of the rubber members 14 resulting from a movement of the box-section beam 11 relative to the connecting rod 13 can result in a relief of the rubber members from a compressive stress but can in no case result in a tensile stress. The connecting rods 13 extend approximately at right angles to the central position of the links 4 so that, during a vibration of the parts 6 and 7 of the grinding tube carrier, the connecting rods 13 remain substantially at rest and the amplitudes of the vibration of the parts 6 and 7 of the grinding tubes are taken up by the rubber members 14, which are correspondingly deformed. The energy, which are correspondingly deformed. The energy which is stored in the rubber members 14 as they are deformed during a movement of the parts 6 and 7 of the grinding tube carrier in one direction is returned to the parts 6 and 7 of the grinding tube carrier when the motion has been reversed because the rubber members bear non-displaceably on the rigid connecting rods 13. For this reason, a relatively low energy is sufficient to drive the grinding tubes 8 inserted in the parts 6 and 7 of the grinding carrier, provided that the parts 6 and 7 are excited to vibrate at a frequency which is approximately as high as the resonant frequency of the vibratory system of masses.

It has been found that metal-clad rubber elements are not desirable everywhere. The use of such metal-clad rubber elements is questionable particularly where high ambient temperatures must be expected. In such cases, the rubber springs may be replaced by a helical spring which is adapted to be stressed in tension and compression, such as is shown in FIG. 6. To enable a suitable connection of the helical spring 16 to a part 6 and 7 of the grinding tube carrier at one end and to the connecting rod 13 or the like at the other end, the end convolutions 17 of the helical spring are smaller in diameter than the remaining convolutions. Each of these end convolutions 17, which are reduced in diameter compared to the remaining spring, is gripped between a mounting plate 19 and a spring abutment plate 18, which is surrounded by the spring and axially pressed by a screw 20 against the mounting plate 19 so that tensile and compressive forces can be transmitted to the helical spring 16 by the end convolutions which are thus gripped. In the embodiment shown in FIG. 6, the mounting plate 19 which is associated with the grinding tube carrier has a mounting angle 21, by which the spring can be secured to one of the parts 6 and 7 of the grinding tube carrier.

An eccentric drive mechanism 22 (see FIG. 2) is mounted in the lower part 7 of the grinding tube carrier and serves to vibrate carrier parts 6 and 7. A motor 24 is mounted in the base frame 1 and serves to drive the eccentric drive mechanism 22 by means of a belt drive 23. Because the eccentric drive mechanism 22 is mounted in the part 7 of the grinding tube carrier, the belt drive 23 extending approximately at right angles to the direction in vibration must take up small changes of the distance between the belt pulley 25 (see FIG. 9) associated with the eccentric drive mechanism and the drive motor 24; such changes occur during the vibration. The connecting rod 26 of the eccentric drive mechanism extends also approximately at right angles to the central position of the links and is not directly connected to the eccentric 28 but is connected thereto by a bushing 27 which is non-rotatably connected to the eccentric 28 by a spline 29. A mounting ring 31 is freely rotatably mounted on the bushing 27 by means of a rolling-element bearing 30 and has a radial lug 32, to which the connecting rod 26 is bolted.

The eccentric shaft 33 is mounted by means of rolling-element bearings 34 on the beams 10 of the lower part 7 of the grinding tube carrier and can be driven by means of the belt pulley 25. In heavy machines, the eccentric shaft 33 may be driven at both ends rather than only at one end.

As is apparent from FIGS. 3 and 4, the connecting rod 26 extends into a hollow beam 35 and is non-displaceably connected thereto by a web 36 which is disposed in the interior of said beam. For this purpose, the connecting rod 26 is clamped between the web 36 and a pressure plate 37 by means of bolts 38 extending through the connecting rod 26. Like the connecting rods 13, the hollow beam 35 extends between two plates 39 which are secured to the beams 10 of the upper part 6 of the grinding tube carrier. Rubber members 40 are interposed between the beam 10 and the plates 39 and are designed like the rubber members 14 and together with vulcanization-bonded mounting plates 41 form metal-clad rubber elements which are bolted to the plates 39 and the beam 35. To resist the stresses for a long time, the rubber members 40 between the beam 35 and the plates 39 must also be under a suitable compressive stress.

Owing to the eccentricity of the eccentric drive, the connecting rod 26 is deflected to one side and the other during each revolution of the eccentric. The connecting rod is resiliently flexible so that it can take up this deflection without need for an articulated joint.

The elastic connection established by means of the rubber members 40 between the eccentric drive mechanism and the upper part 6 of the grinding tube carrier ensures that the vibration of the parts 6 and 7 can build up without any problem to the operating condition in which the resonance permits relatively large amplitudes of vibration to be produced by a relatively low driving energy.

It is desirable to change the amplitude of vibration of the grinding tubes for an adaptation of the vibratory mill to different conditions. This can be accomplished by a simple manner in replacing bushing 27 by a bushing whose bore which contains the eccentric has a different eccentricity. The eccentricity of the eccentric drive mechanism is determined by the eccentricity of the eccentric 28 and the eccentricity of the bore of the bushing 27 with respect to the outside diameter thereof. For this reason, a replacement of the bushing 27 changes the eccentricity of the eccentric drive mechanism without affecting the strength and the load capacity of the arrangement.

Because the grinding tubes 8 are supported by mens of the carrier parts 6 and 7 on the links 4 and the dimensions of the parallel crank linkage formed by these elements of construction are such that the required amplitudes of vibration usually amounting to 20–30 mm involve only very small angular movements of the links 4, the bearings for the links 4 and the parts 6 and 7 of the grinding tube carrier must fulfill high requirements which cannot be fulfilled by rolling-element bearings. For this reason, it is a preferred feature of the invention that the bearing 3 and 5 comprise bearing bushings which consist of a rubber ring 42, a vulcanization-bonded split metallic inner shell 43 and a vulcanization-bonded metallic outer shell which is composed of three spaced apart shell parts 4 (FIG. 7). When the bushing is installed (FIG. 8), the rubber ring 42 is subjected to a radial compressive stress between the inner shell 43 and the outer shell 44 because the clearance between the installed journal 45 and the bearing bore 46 is smaller than the thickness of the bearing bushing when the same is under no load. To subject the rubber ring to a radial compressive stress, it must be possible to change the diameter of the outer shell and/or the inner shell so as to fit the predetermined clearance. This is made possible by the use of an outer shell consisting of a plurality of shell parts and by the use of a split inner shell. Because the inner shell is immovably fitted on the journal 45 and the parts 44 of the outer shell are non-rotatably held in the bearing body 47 formed with the bearing bore 46, any rotation of the bearing body 47 around the bearing bore 46 will be taken up by the rubber ring 42. A tensile stress of parts of the rubber ring will be reliably prevented because the ring is under a radial initial stress. For this reason, the bearing bushings used according to a preferred feature of the invention are not subjected to a particularly high wear so that a long life of the bearings is ensured in spite of the undesireable unilateral stresses on the bearing.

Because the grinding tubes 8 are mounted in a parallel crank linkage having links 4 which can vibrate about a central position which is inclined 45° from the horizontal end which are connected by parts 6 and 7 of the grinding tube carrier, which parts are connected by elastic spring means, the grinding tubes 8 may be excited in a simple manner and with a low energy to vibrate with a comparatively large amplitude and in a direction which is transverse to the tube axes. In case of a vibration which is inclined about 45° from the horizontal, this results surprisingly in a better grinding action than the use of grinding tubes moved along circular paths. Because a balancing of masses is ensured by the mounting of the vibratory masses, virtually no vibrations are transmitted to the foundation of the vibratory mill even though the same is operated with a large amplitude of vibration.

According to a preferred feature of the invention, the substantially linear vibration of the grinding tubes may be utilized also to feed the material to the ground and to discharge the ground material. To this end, suitable troughs 48 are connected to the parts 6 and 7 of the grinding tube carrier and the axes of said troughs extend transversely to the axes of tubes 8 so that the material to be ground or the ground material is moved in such troughs as in vibratory conveyors. Such troughs 48 are diagrammatically shown in FIGS. 10 and 11. In a feeding station 49 the material to be ground can be charged to the troughs for feeding the several grinding tubes 8 and is conveyed as a result of the vibration of the troughs. Similarly, the ground material can be delivered to a collecting trough 48, which is secured to the part 7 of the grinding tube carrier, as is shown in FIG. 10.

What is claimed is:

1. A vibratory mill for disintegrating material, which comprises 1. a plurality of horizontally extending grinding tubes whose axes are parallel to each other;
2. a carrier whereon the grinding tubes are mounted, the carrier consisting of an upper part and a lower part, a first group of the grinding tubes being mounted on the lower carrier part and a second group of the grinding tubes being mounted on the upper carrier part;
3. at least two pairs of links interconnecting the lower and upper carrier parts, the links forming a parallel crank linkage and having respective ends linked respectively to the lower and upper carrier parts for pivoting about axes parallel to the axes of the grinding tubes;
4. stationary bearings mounting each of the links intermediate the ends thereof for pivoting about an axis parallel to the axes of the grinding tubes;
5. an eccentric drive mechanism arranged to vibrate the carrier in a direction transverse to the axes of the grinding tubes, the drive mechanism including eccentric means for imparting to the carrier an amplitude of vibration of at least 15 mm about a central position of the links which is inclined from the horizontal at an angle of 30° to 60°, the eccentric means being mounted on one of the carrier parts, a first connecting rod connected to the eccentric means, the connecting rod extending at a substantially right angle to the central position of the links, and a spring means connecting the connecting rod to the other carrier part; and
6. connecting means between the carrier parts, the connecting means including second connecting rods extending at a substantially right angle to the central position of the links, and spring means between the rods and the carrier parts.

2. The vibratory mill of claim 1, wherein the central position of the links is inclined from the horizontal at an angle of 45°.

3. The vibratory mill of claim 1, wherein the spring means are rubber springs.

4. The vibratory mill of claim 3, further comprising a housing secured to a respective one of the carrier parts, the connecting rods projecting into the housings, and the rubber springs consisting of at least two metal-clad rubber elements carrying the connecting rods between them and connecting the rods to the housings.

5. The vibratory mill of claim 4, wherein the spring means are helical springs.

6. The vibratory mill of claim 5, wherein each of the helical springs has a convolution at a respective end thereof which has a smaller diameter than that of the remaining helical spring convolutions, mounting plate and an abutment plate at each spring end gripping the end convolution therebetween, the abutment plate being surrounded by adjacent ones of the convolutions and a threaded fastener pressing the abutment plate against the mounting plate, and each mounting plate being secured to a respective one of the carrier parts.

7. The vibratory mill of claim 1, further comprising mountings pivotally linking the link ends and the carrier parts, the mountings each comprising a journal secured to a respective one of the carrier parts and a bearing bushing defining a bearing bore and secured to a respective link end, each bushing including a rubber ring, a split metallic inner shell vulcanization-bonded to the rubber ring, and a metallic outer shell vulcanization-bonded to the rubber ring, the outer shell consisting of at least two parts spaced apart from each other, the inner shell being held non-rotatably on the journal, the outer shell being held non-rotatably in the bearing bore, and the rubber ring being held under radially compressive stress between the inner and outer shells.

8. The vibratory mill of claim 1, wherein the first connecting rod connected to the eccentric means is resiliently flexible.

9. The vibratory mill of claim 1, wherein the eccentric drive mechanism comprises a replaceable bushing non-rotatably carried by the eccentric means and the first connecting rod is rotatably mounted in the bushing.

10. The vibratory mill of claim 1, further comprising feeding troughs for feeding the material to be disintegrated to the grinding tubes and discharge troughs for discharging the disintegrated material from the grinding tubes, the feeding troughs being secured to the upper carrier part and the discharge troughs being secured to the lower carrier part, and the troughs extending transversely to the axes of the grinding tubes.

* * * * *